US006151962A

United States Patent [19]

Le et al.

[11] Patent Number: 6,151,962

[45] Date of Patent: Nov. 28, 2000

[54] PORTABLE TESTER FOR DOWNHOLE MOTORS

[75] Inventors: Tuong T. Le, Houston; Gunther von Gynz-Rekowski, Magnolia, both of Tex.

[73] Assignee: Intedyne, LLC, Houston, Tex.

[21] Appl. No.: 09/274,073

[22] Filed: Mar. 22, 1999

[51] Int. Cl.[7] ..... G01L 3/12

[52] U.S. Cl. ..... 73/152.54

[58] Field of Search ..... 73/116, 9, 168, 73/152.54; 81/472, 473, 476; 464/45

[56] References Cited

U.S. PATENT DOCUMENTS

| | | | |
|---|---|---|---|
| 2,731,864 | 1/1956 | Davies et al. | 81/476 |
| 3,208,316 | 9/1965 | Scribner | 81/476 |
| 3,898,875 | 8/1975 | Knoop et al. | 73/116 |
| 3,969,961 | 7/1976 | Amoroso | 81/476 |
| 4,176,548 | 12/1979 | Cyphelly . | |
| 4,199,032 | 4/1980 | Weiner et al. . | |
| 4,364,277 | 12/1982 | Rundell . | |
| 4,520,681 | 6/1985 | Moore et al. . | |
| 4,552,042 | 11/1985 | Beymer | 81/476 |
| 4,605,107 | 8/1986 | Hallidy et al. . | |
| 4,682,505 | 7/1987 | Morissette et al. . | |
| 5,456,123 | 10/1995 | Parkinson . | |

OTHER PUBLICATIONS

PMV, Inc., Port–A–Dyno, Advertisement, date unknown, 1 page.

Eaton Corporation, Airflex Clutches and Brakes Catalog No. 800, 1990, 2 pages.

*Primary Examiner*—Robert Raevis

*Attorney, Agent, or Firm*—Duane, Morris & Heckscher LLP

[57] ABSTRACT

A simple torque-testing tool, particularly for downhole progressing-cavity motors, easily bolts on to the bearing housing on one end and the bit box on the other end. The assembly is first screwed together where a predetermined amount of preload is applied to opposing clutch surfaces. Opposite ends of the housing are affixed to the bearing housing uphole and the bit box downhole and a predetermined amount of flow is run through the stator housing. If the downhole motor is close to its design operating parameters for a given flow rate, it should be able to drive the bit box despite the drag applied by the opposing clutch surfaces. Failure of the downhole motor to be able to overcome the resistance from the device at the predetermined flow rate indicates that the motor is worn. Torque resistance is applied preferably by stacked Belleville washers which can be stacked in a number of arrangements to alter the amount of force. The applied force from the Belleville washers can be altered by rig personnel when assembling the device. The device can be used on a variety of motor types or applications.

18 Claims, 3 Drawing Sheets

PORTABLE TESTER FOR DOWNHOLE MOTORS

FIELD OF THE INVENTION

The field of this invention relates to testing tools for determining torque output of downhole motors and more particularly, making such determination in the field with a portable testing tool.

BACKGROUND OF THE INVENTION

In the past, downhole progressing-cavity motors have been subjected to a variety of conditions, which in some cases has led to loss of efficiency, if not outright failures, in fairly short order. In some cases this has occurred in less than 20 hours of operating time.

Sometimes wear on such progressing-cavity or Moineau-type downhole motors is indicated by a decline in differential pressure and a decline in the rate of penetration during drilling. When wear on a downhole motor is suspected by the drill crew, the motor is pulled from the wellbore. One prior technique would be to keep a complete spare motor at the drill site so that it could completely replace the motor being taken out. The motor that is suspected to be worn is then shipped off to a shop where it is attached to a large piece of test equipment called a dynamometer. The rotor output shaft, which is connected to the bit box where the drill bit is normally mounted, is affixed to the brake and flow is provided through the stator while the brake gradually increases the rotor load. The performance curves for the downhole motor are consulted for a given flow rate to determine the torque produced when the rotor stalls due to the increasing resistance applied by the brake. The produced torque when the rotor stalls is then compared to the performance chart to determine the degree of wear in the downhole motor assembly.

This technique has decided disadvantages. The drilling may occurring in a remote location where it would take inordinate time to ship the motor to be tested to a facility for the test. Keeping a complete spare on standby is also very costly. Alternatively, the testing equipment that is currently used to determine the torque output of a downhole motor is so bulky and fairly complicated so that it requires experienced personnel to operate it and, therefore, cannot be readily available at the rig site. In fact, for example, in offshore drilling there is frequently no room to locate such bulky equipment on offshore platforms. Additionally, it is expensive to keep trained personnel that can operate such complicated equipment along with the equipment at a rig site. The equipment is not only large and cumbersome, but it must be hooked up to operate when needed and it thus requires one or more trained personnel to be with the equipment on a standby basis should the need occur for testing of a motor whose performance has become suspect.

Accordingly, what is needed is a simple and reliable field technique for performance testing downhole progressing-cavity-type motors. One objective of the invention is to provide a simple device which can be easily affixed in the field to the motor. Another objective of the invention is to make the test tool so simple such that rig personnel can administer the test. Another objective is to make the tool compact and portable so that it can be included with the downhole motor when it is shipped to the field location. Another objective of the present invention is to allow simple modifications to the tool to accommodate a variety of different applied loads to the bit box to test a variety of motors for a variety of anticipated torque conditions at given flow rates with a single tool. Another objective of the present invention is to configure the testing device so that it is accurately preloaded for the appropriate resistance for a given torque, regardless of the amount of force applied by rig personnel to assemble the device. Those and other advantages of the present invention will be more readily understood by those skilled in the art from a review of the preferred embodiment described below.

SUMMARY OF THE INVENTION

A simple torque-testing tool, particularly for downhole progressing-cavity motors, easily bolts on to the bearing housing on one end and the bit box on the other end. The assembly is first screwed together where a predetermined amount of preload is applied to opposing clutch surfaces. Opposite ends of the housing are affixed to the bearing housing uphole and the bit box downhole and a predetermined amount of flow is run through the stator housing. If the downhole motor is close to its design operating parameters for a given flow rate, it should be able to drive the bit box despite the drag applied by the opposing clutch surfaces. Failure of the downhole motor to be able to overcome the resistance from the device at the predetermined flow rate indicates that the motor is worn. Torque resistance is applied preferably by stacked Belleville washers which can be stacked in a number of arrangements to alter the amount of force. The applied force from the Belleville washers can be altered by rig personnel when assembling the device. The device can be used on a variety of motor types or applications.

DETAILED DESCRIPTION OF THE PREFERRED EMBODIMENT

Figure 2:
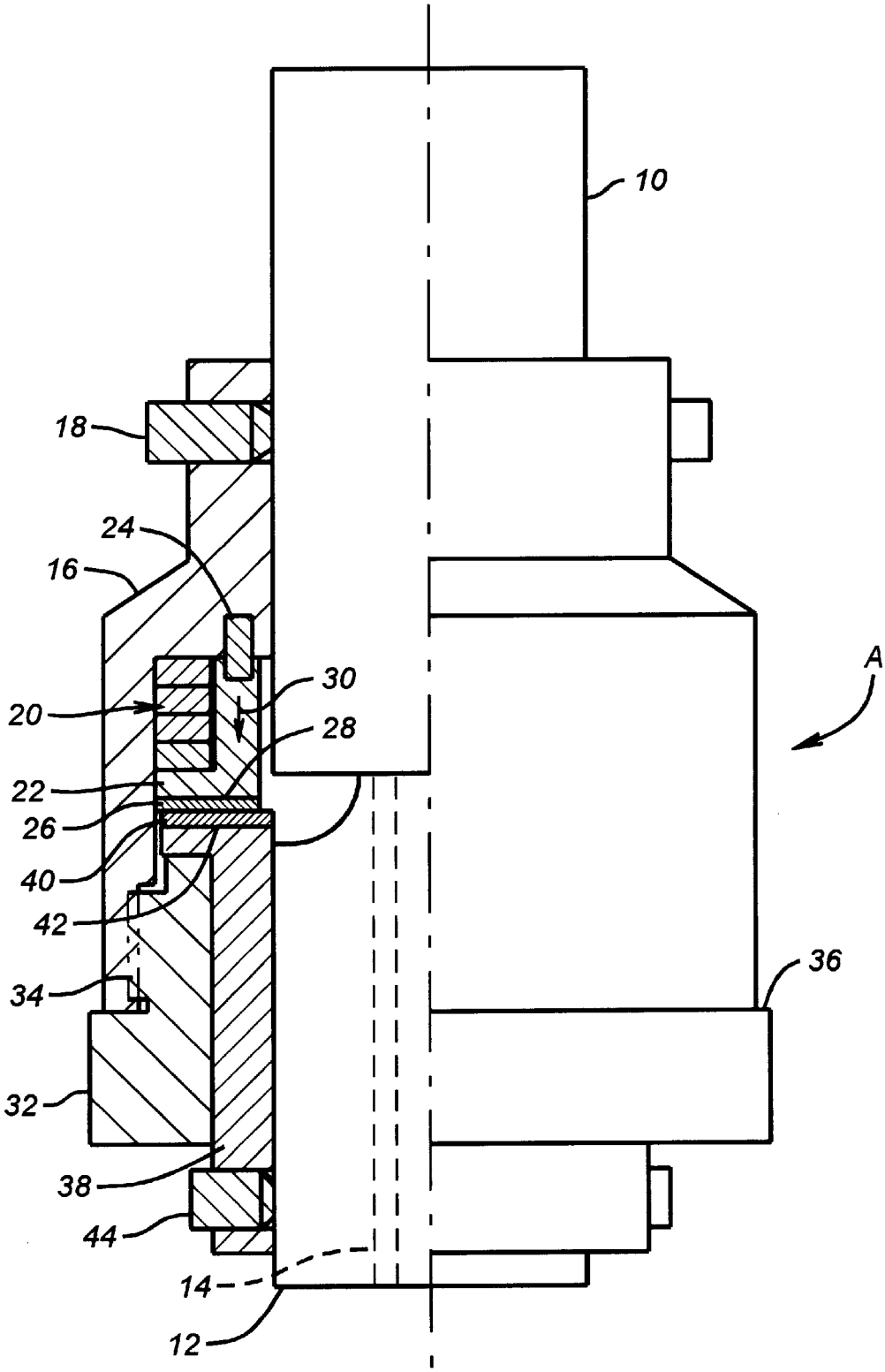
FIG. 2 is a part sectional elevational view of the portable torque tester of FIG. 1, illustrating how it is connected to the bearing housing and bit box.

Referring to FIG. 2, a bearing housing 10, which is ultimately connected to a stator of a progressing-cavity pump (not shown), is illustrated. Emerging from the bearing housing 10 is a bit box 12. The bit box 12 is connected to the rotor (not shown) in the downhole progressing-cavity motor, and ultimately a drill bit (not shown) is connected to the bit box 12. The bit box 12 has internal passages, shown schematically as 14, so that when the bit is connected to the bit box 12, flow that has gone through the progressing-cavity motor can proceed through the bit box 12 and into the drill bit to assist in the removal of cuttings in a known manner.

The apparatus A of the present invention is made up of a top sub 16, which slips over the bearing housing 10 and is secured by a set screw or set screws 18. Affixed internally is a biasing assembly 20 which, in the preferred embodiment, is a stack of Belleville washers. A ring 22 is retained against rotation by a pin or pins 24. Ring 22 has a top clutch plate 26 secured to its lower end 28. The biasing assembly 20 puts a force on top clutch plate 26 in a downward direction, as shown by arrow 30.

A bottom sub 32 is secured to top sub 16 at thread 34. Surface 36, when it engages the top sub 16, prevents further advance of bottom sub 32 into top sub 16. Bottom sub 32 supports a sleeve 38, which has a bottom clutch plate 40 affixed to its upper end 42. When thread 34 is fully made up so that surface 36 touches top sub 16, the top clutch plate 26 is forced against the bottom clutch plate 40 with a force determined by the biasing assembly 20. Stated differently, make-up of thread 34 compresses the stack of Belleville washers which comprises the biasing assembly 20 to a predetermined amount by advancing longitudinally the bottom clutch plate 40 against the top clutch plate 26 until surface 36 touches the top sub 16 and the apparatus A is fully assembled.

After complete assembly, the apparatus A is slipped over the bearing housing 10 and secured to it with set screws 18. The bit box 12 is secured to sleeve 38 by set screws 44. At this time, there is a predetermined preload force driving top clutch plate 26 against bottom clutch plate 40. Bottom clutch plate 40 is secured to the bit box 12. The test commences by applying a predetermined flow rate to the downhole motor. That flow rate progresses through the stator (not shown) and eventually exits through passages 14 in the bit box. At a given flow rate, a particular downhole motor should be able to overcome the predetermined torque resistance applied to the bit box 12 by the biasing assembly 20 acting on top of clutch plate 26, which is, in turn, in contact with bottom clutch plate 40. If, at that predetermined flow rate, the bit box 12 does not rotate, the flow rate can be increased until such time as there is visual indication of rotation of bit box 12. The measured flow rate from the rig equipment through the stator (not shown), which is ultimately required to achieve rotation of the bit box 12, can be compared to the performance characteristics of the downhole motor to determine the deviation from the performance curve required to overcome a predetermined torque resistance. In that sense, the apparatus A gives a coarse indication of the degree of wear that exists in the downhole motor.

Figure 1:
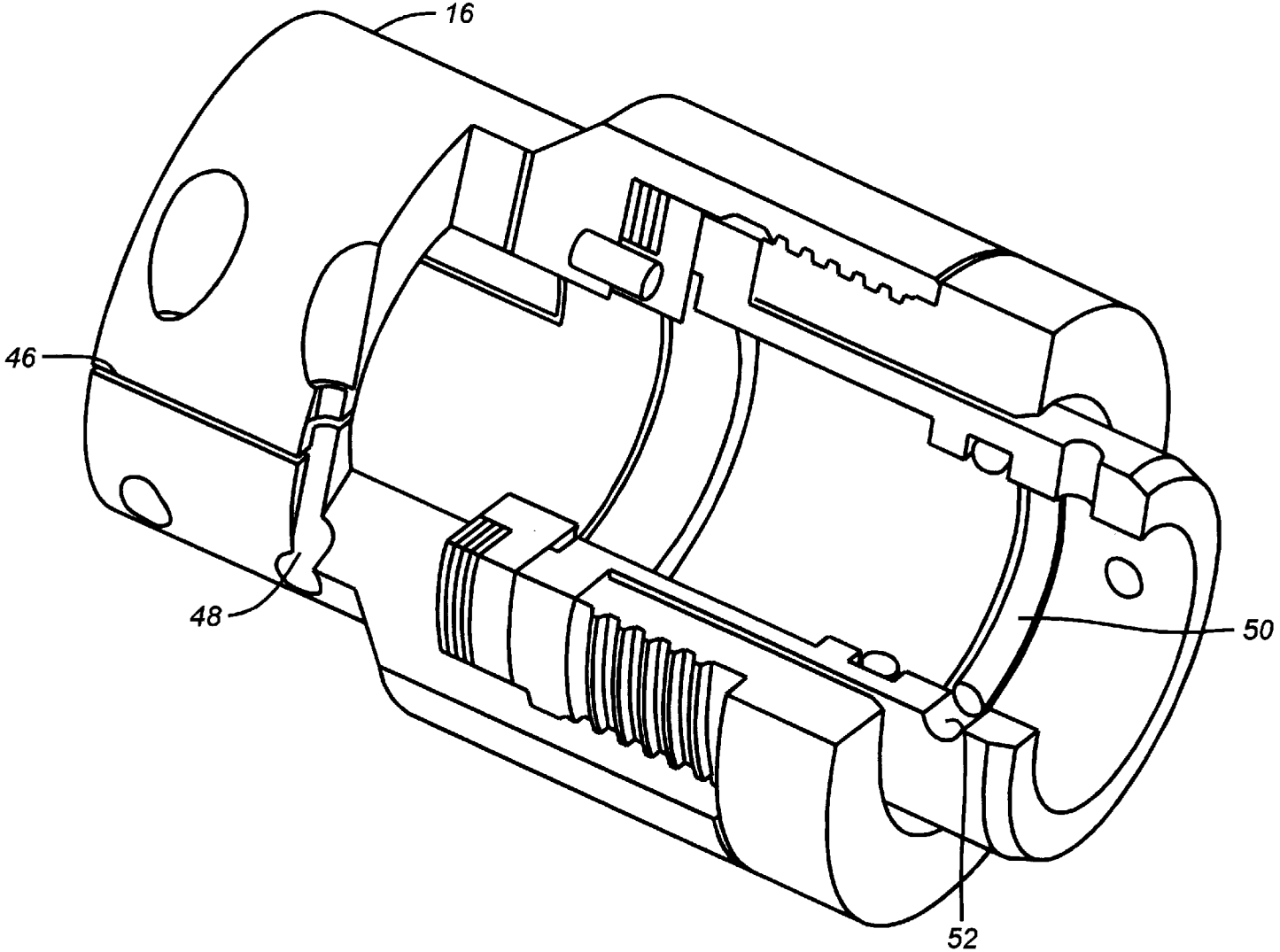
FIG. 1 is a cutaway perspective view of the portable torque tester shown without the bearing housing or bit box which extends therethrough.

Referring to the perspective view of FIG. 1, the top sub 16 can have a split 46 with an aligned set of bores 48 through which a fastener can be inserted for reducing the size of split 46 to cinch up the top sub 16 around the bearing housing 10. Also shown in FIG. 1 and not illustrated in FIG. 2 is an optional seal ring 50 which can keep fluid contaminants out of the apparatus A when it is attached to the bearing housing 10 and bit box 12. In these situations the downhole motor will most likely be stood up at the rig floor. During the test, fluid will come out of passages 14. To avoid getting contaminants splashing back inside the apparatus A, the resilient ring 50 can be employed. FIG. 1 also shows the openings 52 through which the set screws 44 can be inserted for contact with the bit box 12.

Figure 3:
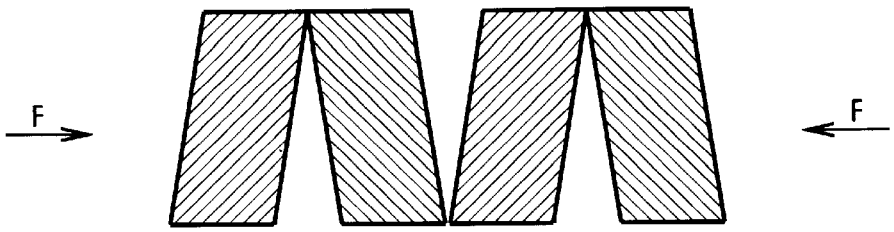
FIGS. 3–6 illustrate alternative arrangements of the Belleville washers to alter the amount of torque resistance applied by the portable torque tester of the present invention.
Figure 4:
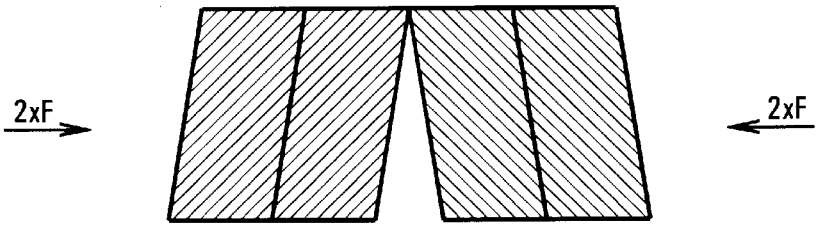
Figure 5:
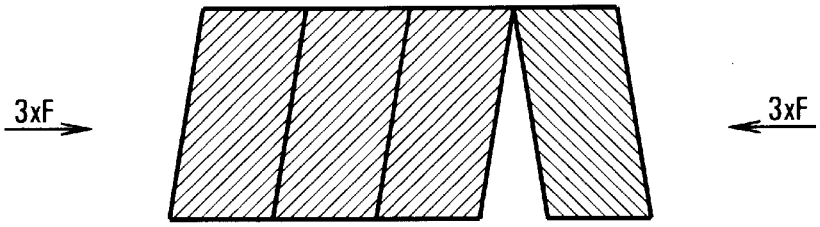
Figure 6:
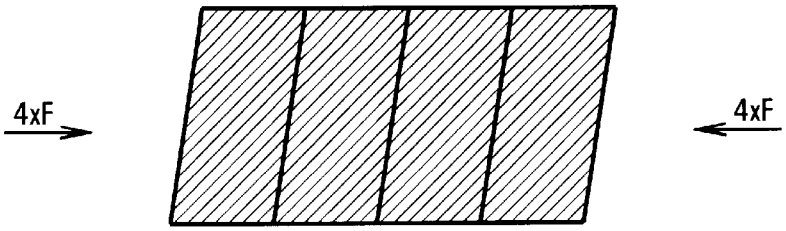

FIGS. 3–6 show different illustrations of a stack of four Belleville washers to enable four different options as to the degree of contact force between clutch plates 26 and 40. It should be noted that other types of biasing devices can be used without departing from the spirit of the invention. It should also be noted that the amount and orientation of the Belleville washers can be changed without departing from the spirit of the invention. FIG. 3 shows two pairs of opposed Belleville washers that yield a baseline force which corresponds to a predetermined break-out torque. FIG. 4 shows two Belleville washers oriented one way and two oriented the opposite way to produce a net force twice as large as the baseline force exerted in the FIG. 3 arrangement. To amplify the force in FIG. 3 by a factor of 3, three of the four washers can be stacked parallel and one stacked opposite, as shown in FIG. 5. In the arrangement of FIG. 6, all of the four Belleville washers are stacked in the same way, which results in a force four times greater applied to the facing clutch plates 26 and 40 than the arrangement in FIG. 3.

Accordingly, the amount of contact force between the plates 26 and 40 can be predetermined by the nature of how the Belleville washers are stacked, or their individual characteristics or number. This arrangement can be accomplished when the apparatus A is originally fabricated or it can be varied by field personnel to meet the desired torque resistance in the apparatus A which occurs due to a variation of the applied contact force pushing plates 26 and 40 against each other. Other simple ways to vary the break-out torque once assembled, or to ensure that the assembly process does not alter the predetermined value of the break-out torque, can be used without departing from the spirit of the invention.

The advantages of the present invention should now be apparent. The apparatus A is small and compact. It can be easily secured to the bit box 12 and the bearing housing 10 with a variety of fastener designs in a matter of minutes. The apparatus A can be easily configured for a predetermined torque which must be supplied in order to rotate the bit box 12 at a predetermined flow rate through the downhole motor. The subs 16 and 32 are configured so that the degree of effort exercised by rig personnel in assembling them will in no way affect the applied contact force between the plates 26 and 40. Accordingly, the biasing assembly 20, depending on the number and configuration of Belleville washers, if those are, in fact, what are used, is the sole determinant of the amount of torque necessary to be applied through the rotor, through to the bit box 12, in order to overcome the contact force between the plates 26 and 40.

With the apparatus A, the serviceability of a downhole motor can be quickly determined. If the bit box 12 will not turn at the predetermined flow rate applied by rig equipment, the degree of wear can be obtained by increasing the flow rate through the downhole motor to obtain sufficient torque output to start the bit box 12 turning. The increased amount of flow required to produce the torque to break out contact between plates 26 and 40 gives an indication of the degree of wear of the downhole motor. Thus, if minimal wear is detected in a test because the bit box 12 begins to turn at or slightly above the flow rate indicated in the performance charts, the downhole motor can be promptly returned to service. More severe wear is detected by elevated flow rates through the downhole motor in order to provide sufficient torque to turn the bit box 12. In other situations, there may be such severe wear that even dramatic increases in the flow rate will not result in the production of sufficient torque to overcome the contact force between the plates 26 and 40.

Another advantage of the apparatus of the present invention is that the break-out torque can be predetermined and the assembly by rig personnel will in no way affect the break-out torque required to allow the bit box to begin turning.

At the conclusion of any test, the fasteners to the bearing housing 10 and bit box 12 can simply be undone and the apparatus A conveniently stored for its next application. In using the apparatus A, trained personnel are not necessary. The overall design of the apparatus A is small so it can be used in locations where space is at a premium for a very quick performance test on the downhole motor when it is retrieved from the wellbore.

The foregoing disclosure and description of the invention are illustrative and explanatory thereof, and various changes in the size, shape and materials, as well as in the details of the illustrated construction, may be made without departing from the spirit of the invention.

What is claimed is:

1. A field test apparatus to determine the condition of a downhole motor, having a housing, housing for the bearings and an output structure defined by a bit box for connecting a downhole tool, comprising:

a top sub secured to the housing;

a bottom sub secured to the output structure;

a clutch assembly operably connected to said subs to prevent their relative rotation until a predetermined torque is applied to said bottom sub;

said clutch assembly further comprises:

a top clutch plate on said top sub;

a bottom clutch plate on said bottom sub;

a biasing assembly pushing one of said plates against the other; said biasing assembly is energized by connection of said subs to each other;

said top sub is selectively securable to the bit box, which serves as the output shaft for the downhole motor;

said bottom sub is selectively securable to the bit box, which serves as the output shaft for the downhole motor.

2. The apparatus of claim 1, wherein:

said biasing assembly comprises at least one spring movably retained by a first sleeve, said top clutch plate mounted to said first sleeve.

3. The apparatus of claim 2, wherein:

said bottom sub comprises a stop surface limiting the travel of said bottom sub when said stop surface contacts said top sub.

4. The apparatus of claim 3, wherein:

said bottom sub further comprises a second sleeve with said bottom clutch plate mounted to it;

said at least one spring is compressed to a predetermined value by said second sleeve in said bottom sub when said stop surface of said bottom sub contacts said top sub.

5. The apparatus of claim 4, wherein:

said at least one spring comprises a coiled spring.

6. The apparatus of claim 4, wherein:

said at least one spring comprises at least one Belleville washer.

7. The apparatus of claim 6, wherein:

said at least one spring comprises a plurality of Belleville washers.

8. The apparatus of claim 7, wherein:

said top sub and first sleeve are configured to accept said washers in a variety of orientations to alter the break-out torque required to be applied to said bottom sub to relatively rotate said bottom sub with respect to said top sub.

9. The apparatus of claim 6, wherein:

said top sub secured to the housing with at least one clamping mechanism.

10. The apparatus of claim 6, wherein:

said top sub comprises a longitudinal split and a fastener which traverses said split to reduce the diameter of said top sub to secure it to the housing.

11. The apparatus of claim 10, wherein:

said bottom sub is secured to the bit box with at least one clamping mechanism.

12. A method of field testing a downhole motor for wear, comprising:

assembling a bottom sub to a top sub;

compressing opposing clutch plates together by said assembling;

slipping said subs over the output shaft and housing of the downhole motor;

securing said top sub to said housing;

securing said bottom sub to said output shaft;

flowing fluid through the downhole motor at increasing rates up until a predetermined value to attempt to drive said output shaft.

13. The method of claim 12, further comprising:

using a progressing-cavity-type motor, having a bearing housing and a bit box as part of its output shaft, as said downhole motor;

comparing the flow rate, if the bit box turns, to a performance specification of the downhole motor;

determining the condition of the downhole motor by said comparing.

14. The method of claim 12, further comprising:

providing a biasing assembly in one of said subs;

limiting the preload to said biasing assembly to a predetermined value which is achieved when a bottom sub surface contacts the top sub.

15. The method of claim 12, further comprising:

mounting a clutch plate on a first and second sleeve;

disposing said sleeves so that said clutch plates face each other, with said first sleeve in said top sub and said second sleeve in said bottom sub;

disposing said biasing assembly on one of said subs so that it biases said clutch plates together when said subs are assembled.

16. The method of claim 15, further comprising:

using at least one spring to bias said first sleeve in said top sub;

using said bottom sub surface to limit the movement of said second sleeve therein.

17. The method of claim 16, further comprising:

using at least one Belleville washer as said spring.

18. The method of claim 17, further comprising:

using a plurality of Belleville washers to force said clutch plates together;

adapting said top sub and said first sleeve to accept said washers in a variety of orientations to achieve a variety of break-out torques to achieve relative movement between said plates.

* * * * *